United States Patent [19]

King et al.

[11] Patent Number: 5,040,348

[45] Date of Patent: Aug. 20, 1991

[54] SHINGLE OR SHAKE PANEL

[75] Inventors: Peter King, Olympia; Richard House, Chehalis, both of Wash.

[73] Assignee: Shakertown Corporation, Winlock, Wash.

[21] Appl. No.: 464,273

[22] Filed: Jan. 12, 1990

[51] Int. Cl.[5] ..... E04D 1/00

[52] U.S. Cl. ..... 52/533; 52/540; 52/541

[58] Field of Search ..... 52/540, 541, 533, 536, 52/521

[56] References Cited

U.S. PATENT DOCUMENTS

| | | | |
|---|---|---|---|
| Re. 27,502 | 10/1972 | Martin . | |
| 2,078,039 | 4/1937 | Stoner | 52/541 X |
| 2,264,546 | 12/1941 | Ochs | 52/541 X |
| 2,384,686 | 9/1945 | Kraus | 52/540 |
| 2,823,426 | 2/1958 | Dunlap | 52/541 |
| 2,935,768 | 5/1960 | Roupe . | |
| 3,284,967 | 11/1966 | Elliott et al. | 52/521 X |
| 3,771,271 | 11/1973 | Keel | 52/540 X |
| 4,015,392 | 4/1977 | Eaton . | |

*Primary Examiner*—Richard E. Chilcot, Jr.
*Attorney, Agent, or Firm*—Robert W. Beach; Ward Brown

[57] ABSTRACT

A shingle or shake panel having a plywood backing and a facing composed of two single-layer courses of shingles or shakes bonded to the backing sheet, the upper edge of the panel being formed as a standing bevel facing away from the front face of the panel and forming an acute angle withthe panel's front face and the lower edge of the panel has an acute-angled groove complemental to the tongue of the upper panel edge, which groove is formed by an under bevel making an acute angle with the back of the panel substantially equal to the acute angle between the standing bevel and the front face of the panel, and the under bevel is recessed to provide an overhang for extending a substantial distance below the standing bevel of a next lower panel with which such panel lower edge portion is assembled to cover a line of nails securing the upper edge portion of such next lower panel to wall structure.

5 Claims, 2 Drawing Sheets

2u
2u
2u
P
2l
2l
2u
2u
2u
P
2l
2l
2l
1
2l
16
13
2u
3
4
P
2l
1
5
13
16
5
1
2u
3
3
P
2l
1
16
13
2u
14
15

SHINGLE OR SHAKE PANEL

BACKGROUND OF THE INVENTION

1. Field of the Invention

This invention relates to a shingle or shake panel and to a process for installing the same.

2. Prior Art

Shake panels have been disclosed heretofore such as in Martin U.S. Pat. No. 27,502, reissued Oct. 10, 1972, including a base strip preferably of plywood covered by an underlayer of wood sawn shingles and an overlayer of wood shakes. Each panel includes only a single course of shakes and shingles in overlapping relationship and such panels are secured to building structure such as roof rafters by rows of nails along their upper edges leaving unsecured the lower portion of the panel which is a major portion of the panel width.

The Roupe U.S. Pat. No. 2,935,768, issued May 10, 1960, discloses wood shingle panels each having only a single course composed of an underlayer of shingles and an overlayer of shingles, the upper and lower edges of which panels are secured to siding or roof sheathing by nails extending through the upper and lower edges of the panels so that the heads of the nails are exposed.

The Kraus U.S. Pat. No. 2,384,686, issued Sept. 11, 1945, discloses a building panel including two courses of wood shingles secured to a gypsum slab or board. In the form of FIG. 2, each course is composed of an underlayer and an overlayer of wood shingles and the form of FIG. 17 has shingles of one panel projecting above the upper edge of the backing slab or board into a pocket behind the lower portions of the shingles of the next higher panel. The upper and lower edges of the slabs may be provided with tongue-and-groove formations, the tongues of which are shown as ridges having an included angle of approximately 90 degrees and the grooves of which are shown as being V-shaped in cross section with a central angle of approximately 90 degrees. The tongues and grooves are only in the edges of the backing slab and not in any portion of the wood shingles secured to the gypsum slab or board.

SUMMARY OF THE INVENTION

It is the principal object of the present invention to provide shingle or shake panels preferably of wood which can be assembled by being nailed securely to a wall structure without the heads of the nails being exposed in the face of the finished wall.

Another object is to provide a type of panel that can be installed in a wall securely by a more convenient and expeditious manner than has been used previously for the installation of shingle or shake panels.

It is also an object to provide a shingle or shake panel which has only a single backing sheet and a single facing layer of shingles or shakes but which is weathertight and which can be assembled with similar panels with weathertight horizontal joints between them.

A further object is to provide a shingle or shake panel and process for installing such a panel which will automatically unbend a panel which may be warped to some extent so that when it is secured in place it will lie flat.

An additional object is to be able to accomplish the foregoing objects by use of a shingle or shake panel which is easy to manufacture and conserves material.

The foregoing objects can be accomplished by manufacturing a shingle or shake panel composed of a backing such as a plywood sheet and a facing formed of one or more single layer courses of shakes or shingles bonded to the backing, the upper and lower edges of which panels are formed as tongues and grooves, respectively, the tongue of the upper edge of each panel being formed as a full standing bevel facing away from the panel front face and forming an obtuse angle with the back of the panel and an acute angle with the front of the panel which tongue can fit wedgingly with the groove in the lower edge of the next higher panel, the backing sheet of which is rabbeted to provide an acute-angled groove complemental to the tongue of the upper edge of the next lower panel and which groove is undercut relative to the margin of the butt portion of the panel to form a weathertight overhang covering the upper margin of the front face of the next lower panel to an extent for providing an adequate nailing line along such upper margin of the next lower panel to enable such upper margin to be secured to building structure on which the panels are mounted.

DETAILED DESCRIPTION

While the panel of the present invention is intended primarily for use in generally upright position covering sidewalls of buildings, the panels could be used, at least in some climates, in upwardly inclined position for making roof structures.

The panel structure is composed of backing formed by a sheet 1 and facing shown as being formed by two single-layer courses of shingles or shakes, namely, a single-layer upper course composed of shingles or shakes 2*u* and a single-layer lower course composed of shingles or shakes 21. The backing and facing components are preferably bonded together such as by thermosetting resin adhesive set in conventional manner by being heated in a dielectrically heated press while the facing and backing are pressed together. The panel is weathertight because the backing sheet 1 underlies the slots between adjacent shingles or shakes.

Figures 1, 2:
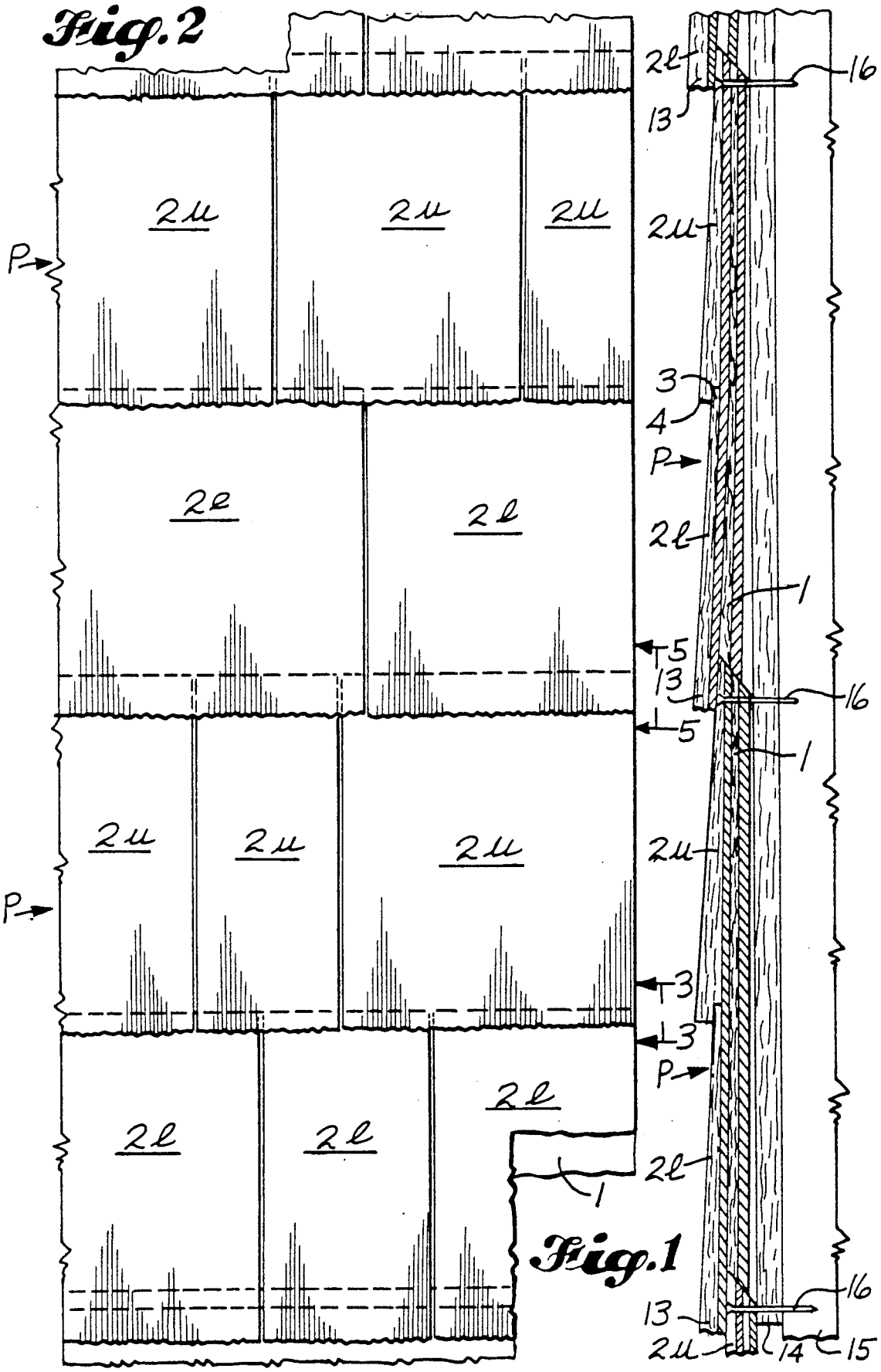
FIG. 1 is a vertical section through a building sidewall to which panels of the present invention have been nailed.
FIG. 2 is a front elevation of a portion of the wall shown in FIG. 1, parts being broken away.
Figure 4:
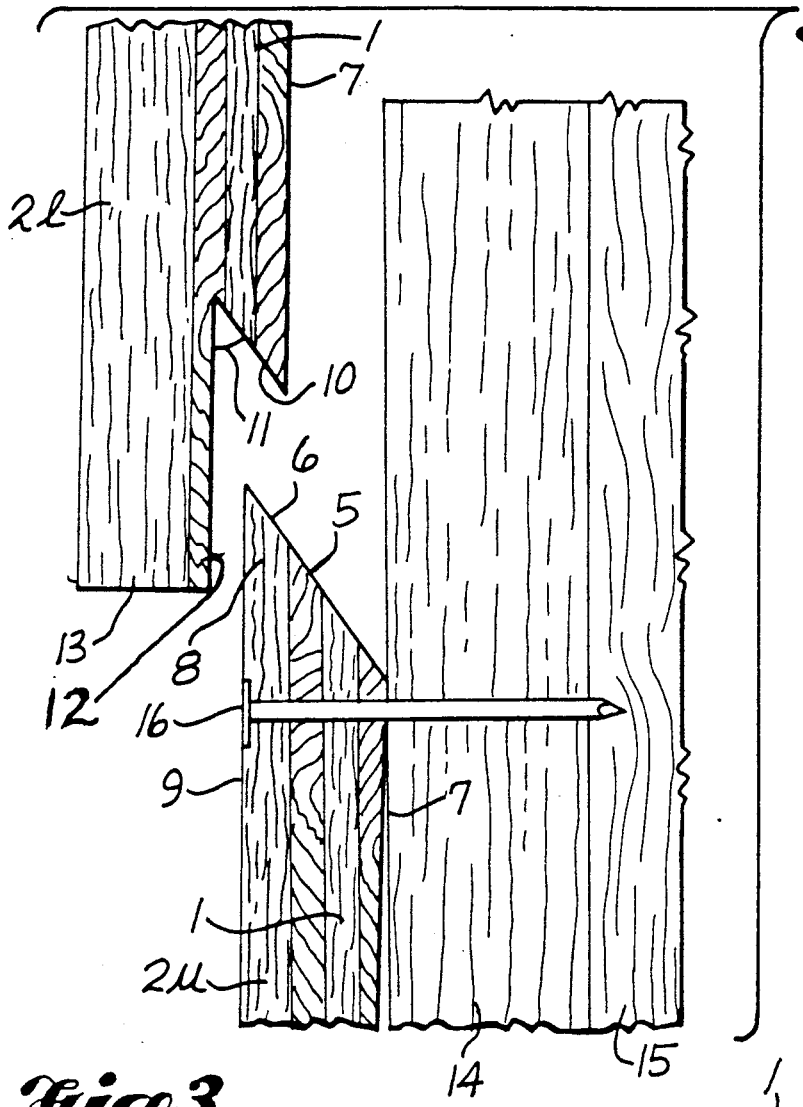
FIG. 4 and FIG. 5 are fragmentary vertical sections through a portion of the wall shown in FIG. 2 taken on line 5—5 of that figure with FIG. 4 showing parts in exploded relationship in the process of being assembled to the installed condition shown in FIG. 5.
Figure 5:
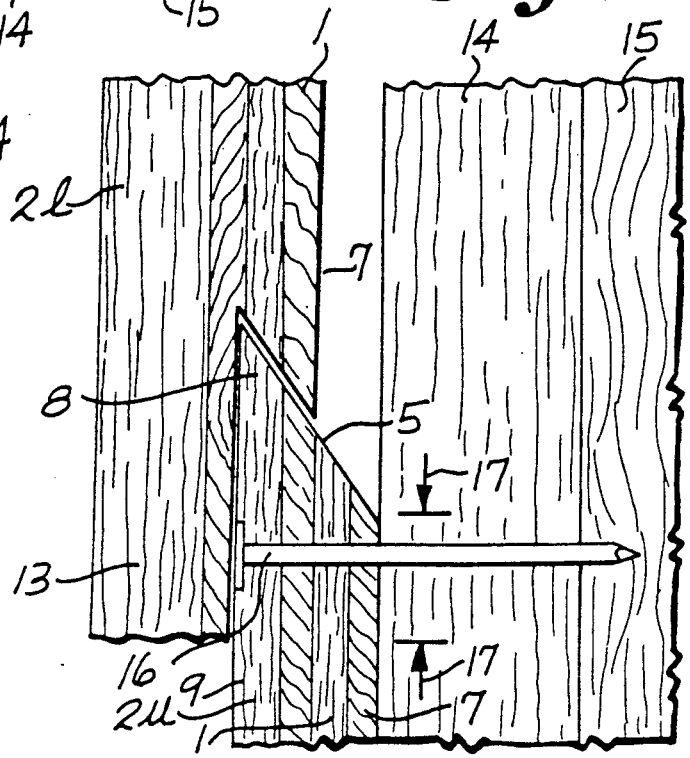

While the backing is preferably of plywood such as exterior grade plywood ¼ inch (7 mm) thick, the backing could be made of other material, such as hardboard, which would have sufficient strength and rigidity to provide a rugged panel. The facing is made of wood shingles or resawn shakes, preferably tapered from butt to tip as shown in FIG. 1 and having a butt thickness at least substantially as great as the thickness of the backing as shown in FIGS. 1, 4 and 5.

Figure 3:
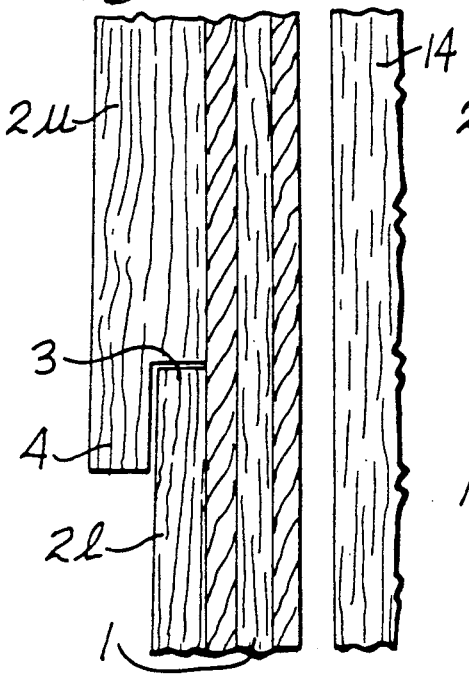
FIG. 3 is an enlarged detail section of a portion of the wall shown in FIG. 2 taken on line 3—3.

Moreover, to provide a panel convenient for handling and installing most expeditiously, it is preferred that the panels have two single-layer courses of shingles or shakes having an exposure to the weather of approximately 7 inches (17.78 cm) so that the height of the panel will be 14 inches (35 cm) to 16 inches (41 cm)

while the horizontal length of the panel will be 48 inches (1.22 m) or 96 inches (2.44 m).

Where the panel facing is composed of two single-layer courses of shakes or shingles, a lap joint will be formed between the upper edges of the shingles 21 in the lower course and the lower edges of the shingles 2u of the upper course as shown best in FIG. 3. The lap joint is formed by the tips 3 of the lower course of shingles or shakes 21 fitting into the rabbet formed in the lower edges of the upper course of shingles or shakes 2u to provide the overhang 4. Preferably, the thickness of the shingle or shake tips 3 is not greater than the width of the rabbet in the butts of the shingles or shakes 2u of the upper course so that the inner sides of the shingle or shake butts 4 which are sawn will fit flat against and be bonded to the outer side of the tips of the shingles or shakes 21 in the lower course to provide a weathertight joint at opposite sides of each slot between adjacent shingles or shakes 2u.

The tips of the shingles or shakes 2u forming the upper course of the panel facing will project only slightly beyond the upper edge of the backing panel 1 as shown in FIGS. 4 and 5. Also, the butts of the shingles or shakes 21 forming the lower course of the panel facing will project downward even with an only slightly below the lower edge of the adjacent portion of sheet 1 forming the backing. The upper and lower edges of the panels are formed as tongues and grooves which interfit when the panels are assembled to form tongue-and-groove joints of special type.

As shown best in FIGS. 4 and 5, the entire thickness of the upper edge of each panel is formed as a full standing bevel extending over both the upper edge portion 5 of the plywood backing sheet 1 and the tip portion 6 of the shingles or shakes 2u forming the upper course of the panel facing and facing away from the front of the panel. The obtuse angle of the standing bevel between the plywood backing sheet edge 5 and the back 7 of the panel is between 135 degrees and 170 degrees and preferably is approximately 150 degrees. Since the backing edge 5 and the shingle or shake tip surface 6 are coplanar, the angle 8 formed between the standing bevel 5, 6 and the front 9 of the panel facing will be approximately the complement of the standing bevel angle so that the tongue angle 8 will be within the range of 45 degrees to 10 degrees and preferably will be approximately 30 degrees.

The lower edge of the backing sheet 1 of each panel is rabbeted to form a recessed under bevel 10. The angle 11 forming the bottom of the panel lower edge groove thus formed will be complemental to the angle 8 of the tongue formed by the standing bevel on the upper edge of each panel. Thus the acute angle 11 between the under bevel 10 and the inner surface 12 of the overhang of the panel will be between 10 degrees and 45 degrees and preferably will be approximately 30 degrees, so that the under bevel surface will be at the same angle to the undercut surface 12 of an overhang 13 containing the butts of the shingles or shakes 21 forming the lower course of the panel facing as the groove-bottom angle 11.

The facing of a panel is formed by a course or courses of shingles or shakes only one layer thick. Consequently, reliance is placed on the backing sheet 1 and its bond to the backs of the shingle or shake facing to make the panel weathertight in the areas of the joints slots between the shingles or shakes. In order to make the overhang 13 of the panel weathertight, it is therefore necessary to have a portion of the lower margin of the backing sheet 1 project downward approximately to the lower edge of the overhang. It is therefore preferred that the groove formed by the under bevel 10 extend from the back 7 of the panel only part of the way through the backing sheet 1. If the backing sheet is made of three-ply plywood, the groove can extend forward from the back of the panel through two of the three plies of the plywood backing sheet. If the plywood backing sheet is ¼ inch (7 mm) in thickness, the total thickness of the panel grooved would be about 3/16 inch (5 mm). Thus, the width of the under bevel 10 would be approximately one-half of the width of the standing bevel 5, 6 formed on the upper edge of the panel which would be approximately ⅜ inch (10 mm) thick.

While, as stated above, it may be feasible to install panels of the present invention for roofs, such panels will usually be utilized to cover sidewalls of buildings as shown in the drawings. In FIGS. 1, 4 and 5, panels are shown as being secured to sheathing 14 and studs 15 of a building by nails 16. Such panels are assembled from the bottom of the wall to the top of the wall. In FIG. 1, two superposed panels are shown as being secured to the sheathing 14 and studs 15 by nails 16 with a fragmentary portion of a third panel being shown as being installed above such two superposed panels. The process for installing such panels is shown best in FIGS. 4 and 5.

When an upper panel has been put in place in proper relationship to a lower panel secured to a building wall structure, it is only necessary to secure the upper marginal portion of such upper panel to the building structure by nails 16. In FIG. 4, the upper margin of a lower panel is shown as being secured flat against the sheathing 14 by nails 16. Such nails must be driven elevationally within the nailing area between the arrows 17 shown in FIG. 5. The groove in the lower edge of such upper panel is undercut sufficiently to provide an overhang 13 which is of an extent sufficient to cover the nailing zone of reasonable size along the upper margin of the lower panel when the tongue of such panel is fitted into the groove in the lower edge of the upper panel. Also, the nails 16 should preferably be driven at locations such that they will penetrate the sheathing 14 and enter at least to some extent studs 15 located behind the sheathing.

Securing the upper margin of a panel to the building structure as shown in FIGS. 4 and 5 will provide an acute-angled tongue 8 projecting upward from the upper edge of the installed panel. The next higher panel is then moved into place alongside the wall so that the acute-angled groove in its lower edge opens downward toward the tongue 8, as shown in FIG. 4. Lowering the upper panel from the position shown in FIG. 4 to the position shown in FIG. 5 will cause the standing bevel of the tongue extending along the upper edge of the lower panel to engage wedgingly the under bevel of the groove in the lower edge of the upper panel so that any warpage which the upper panel may have lengthwise of it will be straightened to enable the upper panel under bevel to fit contiguously against the standing bevel of the lower panel upper edge tongue.

Also, as shown in FIG. 5, the under bevel of the groove in the lower edge of the upper panel will be confined securely behind the standing bevel of the tongue extending along the upper edge of the lower panel so that when the upper panel is secured so that it cannot move upward, the lower edge of such panel is confined so that it cannot move outward. Such securement is effected by driving nails only through the upper nailing area of the upper panel in the zone corresponding to the nailing zone of the lower panel between the arrows 17 shown in FIG. 5. Thus each panel is secured in place by only a single row of nails.

It will be seen from FIG. 5 that the groove in the lower edge of the upper panel is undercut sufficiently so that the overhang 13 will depend below the heads of the nails 16 penetrating the upper margin of the next lower panel so that the nails are never exposed as are the nails 8 shown in FIG. 4 of the Roupe UJ.S. Pat. No. 2,935,768. Both the upper and lower edges of the panels are firmly secured, however, the upper edges of the panels being secured by the nails 16 driven through their margins and the lower edge portions of the panels being firmly secured by engagement of the under bevel groove with the standing bevel tongue extending along the upper edge of the next lower panel.

The effectiveness of the tongue-and-groove joint to engage and hold the lower edge of the next higher panel is maximized because the standing bevel 5, 6 of the lower panel extends across the full thickness of the panel's upper edge so that the outer side of the tongue's acute angle 8 is the outer face 9 of the panel. It is sufficient for the groove in the lower edge of the next higher panel to extend over at least about half of the thickness of the backing 1.

We claim:

1. A shingle or shake panel having a front face and a back face and being adapted to be disposed in generally upright position on a wall or in an upwardly inclined position on a roof comprising a strong backing sheet with a front and back and an upper edge and lower edge, having a lower edge groove forming an under bevel from the back of said backing sheet through more than half of the thickness of said backing sheet and making an acute groove-bottom angle, and a facing composed of at least one course formed by a single layer of shingles or shakes having fronts and backs, tips and buts, the backs of said shingles or shakes in said layer being bonded to the front of said backing sheet and said shingles or shakes having butts at least substantially as thick as the thickness of said backing sheet, the front portion of said backing sheet lower edge and the butts of said facing shingles or shakes projecting downward beyond the apex of said under bevel, said facing shingles or shakes having joints therebetween extending transversely of said backing sheet groove, and the upper edge of the panel being formed by the upper edges of said facing shingles or shakes and at least a portion of the upper edge of said backing sheet disposed in coplanar relationship in the form of a standing bevel facing away from the front face of the panel of a width at least as great as the width of said under bevel and forming an acute angle with the panel's front face substantially equal to the groove-bottom angle of said backing sheet lower edge groove.

2. The panel defined in claim 1, in which the backing sheet is formed of three-ply plywood and the bottom edge groove extends from the back of said three-ply backing sheet through approximately two plies of said three-ply backing sheet.

3. The panel defined in claim 1, in which the acute angles are within the range of 10 degrees to 45 degrees.

4. The panel defined in claim 3, in which the acute angles are approximately 30 degrees.

5. The panel defined in claim 1, in which the width of the standing bevel is approximately twice as great as the width of the under bevel.

* * * * *